United States Patent [19]

Tominaga

[11] Patent Number: 4,599,755

[45] Date of Patent: Jul. 15, 1986

[54] BEAD FLUIDIZING TYPE BODY SUPPORTING DEVICE

[75] Inventor: Hiroshi Tominaga, Kanagawa, Japan

[73] Assignee: Fuji Electric Co., Ltd., Kawasaki, Japan

[21] Appl. No.: 677,070

[22] Filed: Nov. 30, 1984

[30] Foreign Application Priority Data

Nov. 30, 1983 [JP] Japan ..... 58-225774

[51] Int. Cl.[4] ..... A61G 7/00; A47C 27/08

[52] U.S. Cl. ..... 5/453; 5/423; 5/469

[58] Field of Search ..... 5/453, 454, 449, 450, 5/469, 423; 128/38, 33

[56] References Cited

U.S. PATENT DOCUMENTS 3,644,950 2/1972 Lindsay ..... 5/469
3,760,800 9/1973 Staffin et al. ..... 128/38
3,840,920 10/1974 Voelker ..... 5/450
4,245,361 1/1981 Evanson ..... 5/450
4,483,029 11/1984 Paul ..... 5/453

*Primary Examiner*—Alexander Grosz
*Attorney, Agent, or Firm*—Finnegan, Henderson, Farabow, Garrett & Dunner

[57] ABSTRACT

A bead fluidizing type body supporting device including a vessel enclosing fluidizable beads and an open cell type porous elastic member. Air is injected through the bottom of the vessel to fluidize the beads therein and an air permeable film covers the top of the vessel and is adapted to support a body thereon in a floated state when the beads are in the fluidized condition. The elastic member may be located above, below, or intermediate the beads within the vessel and has cells with diameters larger than the diameters of the beads.

5 Claims, 4 Drawing Figures

BEAD FLUIDIZING TYPE BODY SUPPORTING DEVICE

FIELD OF THE INVENTION

This invention concerns a bead fluidizing type body supporting device that prevents bedsores on a patient lying on the body supporting device, for example, a bed, by supporting the patient in a substantially floating state.

BACKGROUND OF THE INVENTION

The construction and the operation of a conventional bead fluidizing type body supporting device will first be explained with reference to FIG. 1. A bed 1 comprises a box-like vessel 3 of a size sufficient to enable a patient 2 to lie thereon, ceramic beads 4, for example, minute glass or ceramic particles having specific gravity of 2–3 and particle size of about 50–150 u, a gas permeable filter sheet 5 covering the upper surface of the vessel 3 and secured to the peripheral edge thereof with a mesh finer than the particle size of the beads 4, a plenum chamber 6 disposed on the bottom side of the vessel 3, a porous air diffusion plate 7 disposed at the boundary between the plenum chamber 6 and the vessel 3, an air blower 9 accommodated within a machine chamber 8, a conduit 10 for connecting the air blower 9 and the plenum chamber 6 to supply compressed air, and a heat dissipator 11 disposed midway in the conduit 10. The ceramic beads 4 may be coated with a resin.

In such a construction, the beads 4 are stationary when the air blower 9 is not operated to give the patient 2 lying on the bed a feeling like that of lying on sand. When the air blower 9 is operated to blow compressed air into the vessel 3 by way of the plenum chamber 6 and the air diffusion plate 7, as shown by the arrow A, the compressed air permeates throughout the inside of the vessel 3. The beads 4, sealed within the vessel 3 by the filter sheet 5, are fluidized by the streams of the compressed air to establish a floating state.

In the floating state, the apparent specific gravity of the beads 4 is reduced to about 1.1–1.2 to sustain the patient lying thereon in a substantially floating state wherein the contact pressure between the patient 2 and the bed 1 is greatly reduced and the patient feels as if he is floating in the air. The compressed air continuously passes through the vessel 3, permeates the sheet 5, and is diffused into the surrounding room. The air exhausted from the air blower 9 is heated about 10–20 degrees in the compression stroke. If air at such a high temperature is directly blown against the patient 2 troubles in the therapy may arise. Accordingly, the heat dissipator 11 must be provided at the midway point of the conduit 10.

Such a body supporting device, however, can provide therapeutic effects in treatment of a patient suffering from burns and suppress contact pressure to lesions. Decreasing the contact pressure between a patient undergoing long time therapy and a bed can also prevent bedsores.

In the conventional body sustaining device as described above, if a patient changes his position from that of lying to that of sitting on the bed, his body weight is localized and his hips sink to result in an unstable position. Further, if the depth of the bed vessel 3 is small, the hip may come in direct contact with the hard air diffusion plate 7 and suffer from strong contact pressure. If the patient sits for a long period of time, the increased contact pressure is undesirable from the perspective of preventing bedsores.

It is not practicable to prevent such excess sinking of the body by increasing the volume and pressure of the air blown into the vessel from the air blower 9 to increase the floating effect of the fluidized beads. This is because the air stream blown out from the sheet 5 would be increased excessively and the mechanical noise would become undesirable.

OBJECTS AND SUMMARY OF THE INVENTION

In view of the shortcomings of the prior act, an object of the present invention is an improved bead fluidizing type body supporting device.

Another object of the present invention is a bead fluidizing type body supporting device which prevents the formation of bedsores on a bed-ridden patient.

Still another object of the present invention is a bead fluidizing type body supporting device which comfortably supports a person sitting thereupon.

A further object of the present invention is a bead fluidizing type body supporting device that is durable and equally effective for various positions of a body supported thereon.

These and other objects are achieved by a bead fluidizing type body supporting device comprising a vessel having a first portion vertically disposed above a second portion, an open cell type porous elastic member in one of the first and second portions, beads in the other of the first and second portions, means for injecting air into the vessel to fluidize the beads therein, and an air-permeable sheet covering the top of the vessel and adapted to support a body thereon in a floated state when the beads are in the fluidized condition.

BRIEF DESCRIPTION OF THE DRAWINGS

The manner in which these and other objects, features, and advantages of the present invention are achieved will become more apparent from the following detailed description when considered with reference to the drawings, wherein.

DETAILED DESCRIPTION

Figure 2:
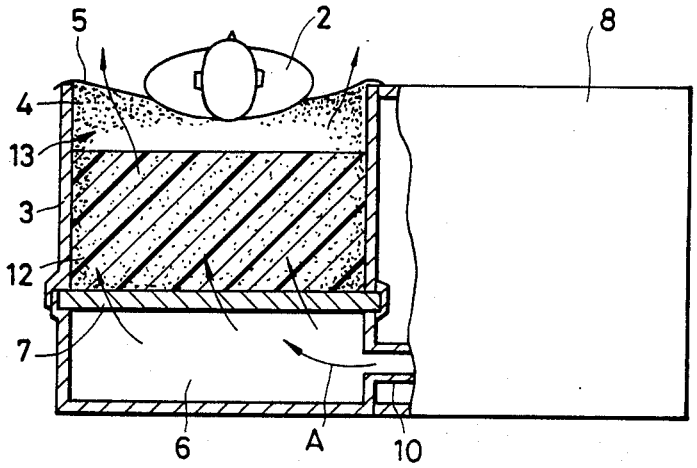
FIG. 2 is a cross-sectional view of a bead fluidizing type body supporting device according to the present invention showing a patient lying thereon.
Figure 3:
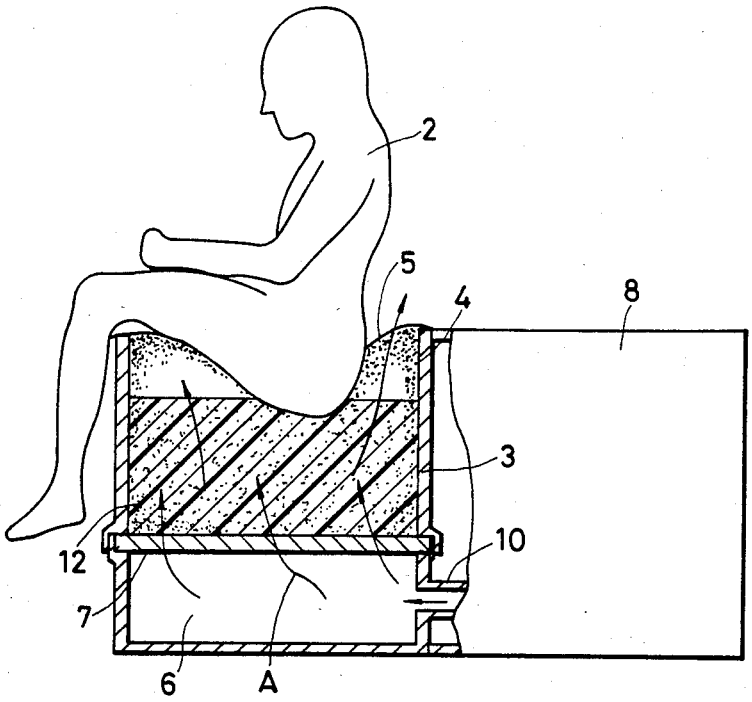
FIG. 3 is a cross-sectional view of a bead fluidizing type body supporting device according to the present invention showing patient sitting thereon.

FIG. 2 and FIG. 3 respectively show the construction of one embodiment of a bead fluidizing type body supporting device of the present invention wherein a patient is in lying and sitting positions. A mat-like, open cell type porous elastic member 12 is provided with the beads 4 inside of the vessel 3. The porous elastic member 12 comprises, for example, low density soft foam prepared from high molecular material such as polyurethane resin subjected to foaming fabrication. The member 12 includes a majority of open cells with a pore size of about 4–5 mm, i.e., larger as compared with the particle size of the beads 4. As illustrated in the drawings, the elastic member 12 is laid at the lower portion of the vessel 3 while leaving space as the bead fluidizing space 13 in the upper portion of the vessel 3.

Figure 1:
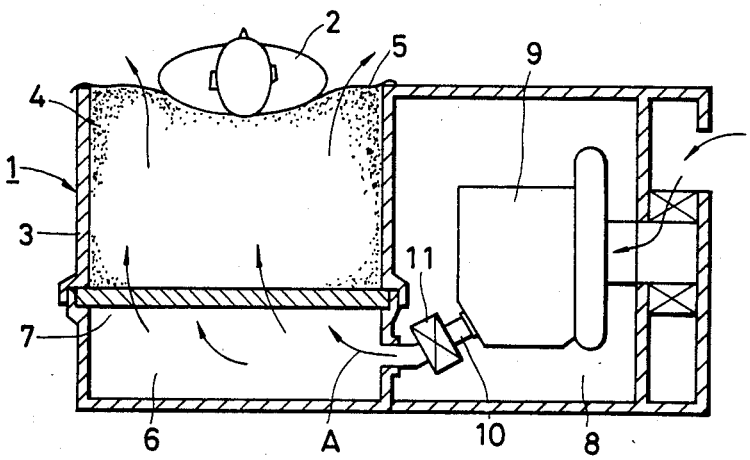
FIG. 1 PRIOR ART
FIG. 1 is a cross-sectional view of a conventional bead fluidizing type body supporting device.

In the construction as described above, the beads 4 within the vessel 3 are located not only in the upper space within the vessel 3 but also in the open cell pores of the porous elastic member 12 and are mixed therewith when no compressed air is being injected through the bottom of the vessel 3. When the air blower 9 is operated to blow compressed air from the plenum chamber 6 to the inside of the vessel 3, the beads 4 are fluidized under the pressure of the air stream and, accordingly, the patient 2 lying on the sheet 5 is sustained in a floated state as shown in FIG. 2 and in the same manner as shown in FIG. 1.

On the other hand, if the patient takes a sitting position on the bed as shown in FIG. 3, the body weight is more localized as compared with the state of lying shown in FIG. 2, and sinking of the body tends to increase. The elastic member 12, however, sustains a portion of the load exerted by the localized body weight by its resilient stress and sinking of the hips of the patient does not become excessive. As a result, the patient can sit in a stable sitting position. Furthermore, since the elastic member 12 does not apply a large pressure to the patient 2, the benefits of protection of lesions and prevention of bedsores are still obtained. Also, since the body does not sink excessively, the depth of the vessel 3 can be significantly reduced and the weight of the bed device can be decreased.

Figure 4:
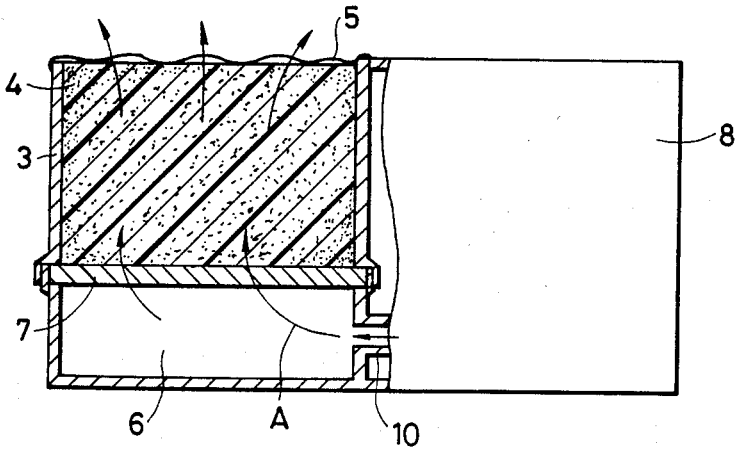
FIG. 4 is a cross-sectional view of another embodiment of a bead fluidizing type body supporting device according to the present invention.

FIG. 4 shows another embodiment of the present invention, in which the thickness of the mat-like open cell type porous elastic member 12 is larger as compared with that in the embodiment of FIGS. 2 and 3. The elastic member 12 may be incorporated and laid while filling the inside of the vessel 3 such that the upper surface of the mat 12 is substantially flush with the upper surface of the vessel 3. In this construction, the elastic member 12 sustains a large portion of the body weight in the lying state in conjunction with the floating force accompanying the flowing of the beads during fluidized operation. This embodiment is particularly suited for a heavy patient.

In addition, and as further modified embodiments according to the present invention, the elastic member 12 may be laid only at the upper portion of the vessel 3, or at a vertically intermediate portion inside of the bed vessel 3. Furthermore, this invention can be applied to a chair-like construction such as a wheelchair as well as to a bed designed so as to also serve as a sofa, to attain the object of preventing bedsores.

As described above, according to the present invention, since a mat-like open cell type porous elastic member 12 is incorporated and laid together with the beads 4 inside of vessel 3 and adapted such that the elastic member 12 may resiliently sustain a portion of the load of body weight in conjunction with the floating force due to the fluidization of the beads, excess sinking of body can be prevented while keeping the contact pressure applied to the body at a low level even in a sitting, position. Furthermore, a bead fluidizing type body supporting device of a high practical advantage can be provided in that there is no risk that the body may, abut against a hard bottom of the vessel 3.

It should be understood what the present invention is not limited-to the particular embodiments described, but rather is susceptible to modifications, alterations, and equivalent arrangements within the scope of the appended claims and their equivalents.

What is claimed is:

1. A bead fluidizing type body supporting device comprising:
   - a vessel having a first portion vertically disposed above a second portion;
   - an open cell type porous elastic member in one of said first and said second portions;
   - beads in the other of said first and said second portions;
   - means for injecting air into said vessel to fluidize said beads therein; and
   - an air-permeable sheet covering the top of said vessel and adapted to support a body thereon in a floated state when said beads are in said fluidized condition.

2. A bead fluidizing type body supporting device according to claim 1, wherein said open cell type porous elastic member comprises soft foam made of polymeric material.

3. A bead fluidizing type body supporting device according to claim 1, wherein the cell pore size of the open cell type porous elastic member is larger than the average diameter of said beads.

4. A bead fluidizing type body supporting device according to claim 1, wherein said elastic member is located in said first portion.

5. A bead fluidizing type body supporting device according to claim 1, wherein said elastic member is located in said second portion.

* * * * *